United States Patent [19]

Arce

[11] 4,077,347

[45] Mar. 7, 1978

[54] HALYARD LATCH APPARATUS FOR A SAILBOAT

[75] Inventor: Henry Leyva Arce, San Juan Capistrano, Calif.

[73] Assignee: Coast Catamaran Corporation, Irvine, Calif.

[21] Appl. No.: 809,459

[22] Filed: Jun. 23, 1977

[51] Int. Cl.[2] ..... B63H 9/04

[52] U.S. Cl. ..... 114/108

[58] Field of Search ..... 114/104, 108–115; 24/115 R, 115 B; 294/74–75

[56] References Cited

U.S. PATENT DOCUMENTS

| | | | |
|---|---|---|---|
| 514,710 | 2/1894 | Gutenkunst | 212/85 |
| 670,288 | 3/1901 | MacDonald | 114/111 |
| 1,159,388 | 11/1915 | Jacobs | 104/73 |
| 2,518,276 | 8/1950 | Brawand | 294/74 |
| 3,040,690 | 6/1962 | Harless | 114/108 |
| 3,343,514 | 9/1967 | Brett | 114/108 |

*Primary Examiner*—Trygve M. Blix
*Assistant Examiner*—Jesus D. Sotelo

[57] ABSTRACT

A halyard line extends over a pulley at the top of a mast and is connected to the head of the mainsail by a ring connector. Beneath the pulley, a hook plate with a pivoting pawl is secured to the mast. When the halyard line is pulled, the sail is raised, and the shackle engages the pawl and forces it upwardly thereby exposing the catch of the hook plate so that the ring will be seated in the catch and held by the hook plate. When it is desired to lower the sail, the halyard is pulled until the ring rises above the pawl and the pawl will fall to cover the catch when the halyard is released. The top of the pawl guides the ring down and beyond the hook plate until it is free. The sail may then be fully lowered.

4 Claims, 9 Drawing Figures

HALYARD LATCH APPARATUS FOR A SAILBOAT

BACKGROUND AND SUMMARY

The present invention relates to halyard latch mechanisms of the type which are used on masts for sailboats. It is well known that it is desirable to secure the head of the mainsail directly to the top of the mast, as distinguished from securing the halyard to the base of the mast. Hence, the present invention relates to a halyard latch mechanism for securing the head of the sail to the top of the mast when the sail is raised. The latch mechanism must be releasable by manipulation of the halyard line from the boat.

Mechanisms are known for securing the head of a sail to the top of a mast, but for the main, it has proved difficult either to secure the mechanism or to release it. For example, in one prior mechanism a pair of fingers extend rearwardly from the top of the mast and the halyard is provided with a ball or lug which seats in the fingers to secure the halyard in the raised position. These mechanisms have proved difficult to latch, and even more difficult to release when it is appreciated that latching and releasing must be accomplished by an individual operating the halyard line from within the boat while the latching mechanism located at the top of a mast which may be as high as 24–28 feet, particularly in the case of a catamaran sailboat. In a modification of this basic mechanism, the ball is located in a forward slot and a larger rear slot is used for releasing the mechanism as disclosed in U.S. Pat. No. 3,343,514.

According to the present invention, apparatus for selectively latching the mainsail is located at the top of the mast. A halyard line is routed around a pulley at the top of the mast and is connected to the head of the mainsail by means of a connector ring (or shackle). Beneath the pulley, a hook plate is secured to the mast and extends rearwardly. At the distal end of the hook plate a concave surface is provided on the upper edge, and this forms a catch for the connector ring.

The lower edge of the hook plate defines a guide surface which extends from a first location on the mast beneath the catch upwardly to a second location just aft of the catch. Thus, as the halyard line is pulled, the top of the ring rides along the guide surface on the hook plate where it is brought into engagement with a pawl. The pawl includes a nose portion which extends rearwardly beyond the hook plate and is therefore engaged by the connector ring when the halyard line is pulled. As the sail is raised further, the pawl is rotated to a second position on which the catch is accessible to the ring so that when the halyard line is released, the ring is seated into the catch on the hook plate.

When it is desired to release the latch, the halyard line is again pulled until the connector ring rises above the pawl. The pawl then falls downwardly alongside the hook plate, the upper edge of which is curved so that when the halyard is again released, the top of the ring will ride along this upper curved edge of the pawl and be cammed out beyond the hook plate until it is free of the latch mechanism. The mainsail may then be lowered fully.

The present invention thus provides a convenient and economical latch mechanism for a halyard line and one which is readily maneuverable under sailing conditions by a person standing at the base of the mast even though the mast itself may have a substantial height.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
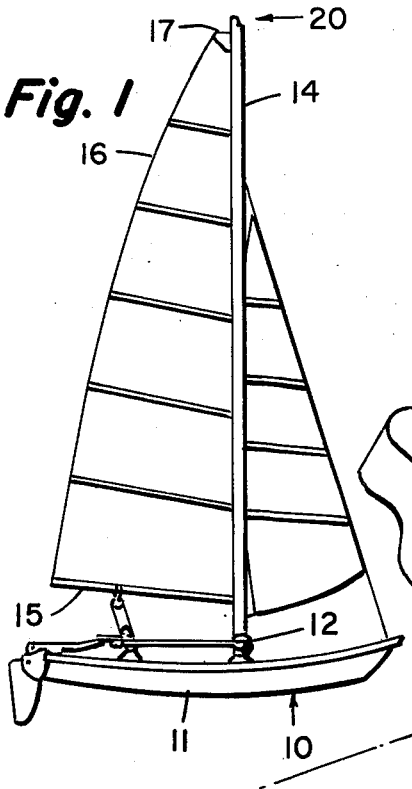
FIG. 1 is a side view of a catamaran sailboat incorporating the present invention.

Referring first to FIG. 1, there is shown a catamaran sailboat generally designated by reference numeral 10. The sailboat 10 has two elongated hulls, one of which is seen at 11 and the other is hidden from view. The hulls are maintained in spaced relation by a rigid metal frame generally designated 12 which functions not only to rigidly join the hulls together but to provide a framework for a flexible deck or trampoline for holding the occupants of the boat.

A mast 14 is mounted to a forward cross bar of the frame 12 at the transverse center thereof; and a boom 15 is pivotally mounted to the mast 14. A mainsail 16 is supported by the mast 14 and the boom 15, and the head of the sail is designated 17.

Figure 2:
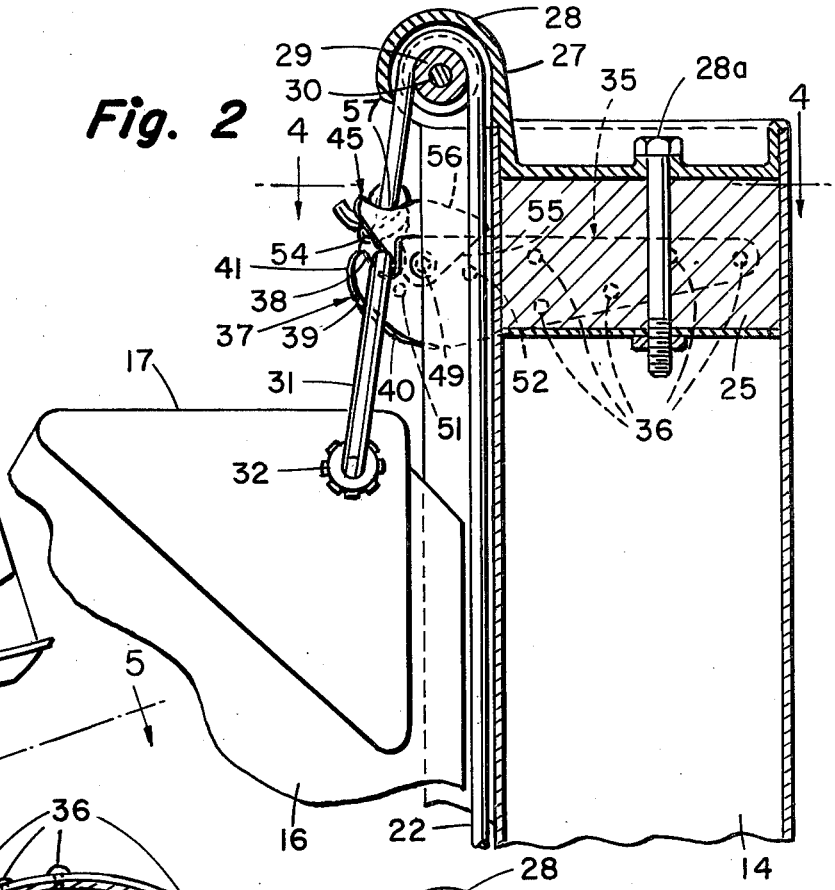
FIGS. 2 and 3 are vertical cross section views as seen from the right side, taken through the top of the mast in a fore-to-aft plane with the ring latched and raised for release respectively.
Figure 4:
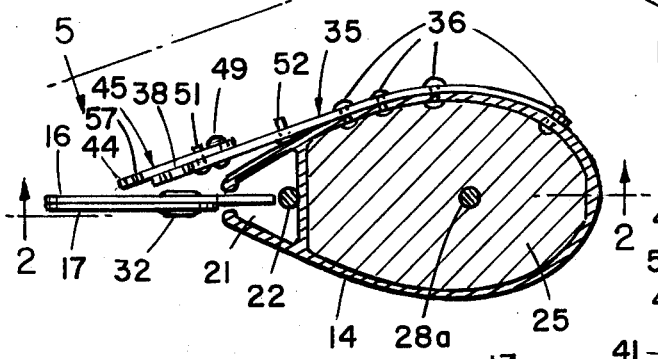
FIG. 4 is a horizontal cross sectional view taken through the sight line 4—4 of FIG. 2.
Figure 3:
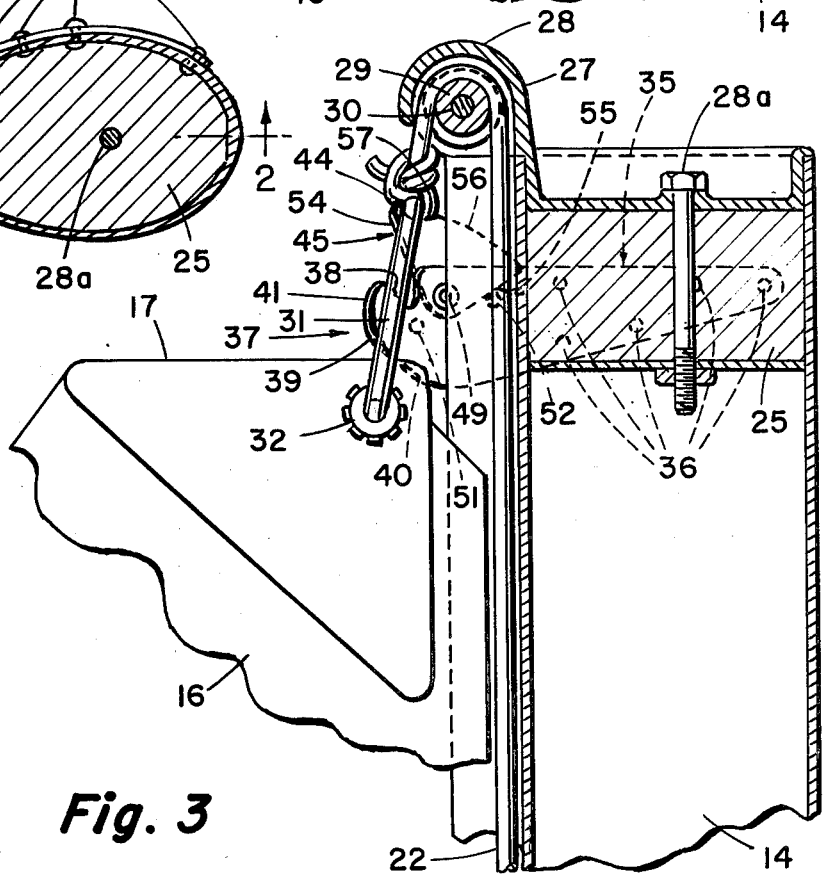

The head 17 of the sail is secured to the top of the mast by a halyard latch mechanism generally designated by reference numeral 20 and seen in greater detail in FIGS. 2–4.

Turning then to FIGS. 2–4, the mast 14 is seen from the horizontal cross section of FIG. 4 to have general teardrop shape with a narrowed aft portion defining a vertical channel 21, which receives a bolt rope secured to the luff of the mainsail for attaching it to the mast.

The top of the mast 14 is enclosed by means of a plug or core material 25, and a casting 27 is secured by means of a bolt fastener **28*a* to the core 25. The casting 27 includes a cover portion 28 which fits over a pulley 29 journaled on a shaft 30. The halyard line 22 extends over the pulley 29 and is secured to a ring connector 31 which, in turn, is fitted through a grommeted hole in the head 17** of the mainsail.

A hook plate generally designated by reference numeral 35 is riveted to the port side of the mast 14 at the locations designated 36. The hook plate 35 includes a latch portion 37 which extends aft of the mast and includes a concave surface providing a catch or seat 38 to receive the ring 31 and hold it in the latched position of FIGS. 2 and 7.

The lower rear edge of the hook plate is designated 39, and it extends from a first position 40 adjacent the rear of the mast and beneath the catch 38; and it extends upwardly and rearwardly in smooth conformation to a second position 41 immediately aft of the catch 38. The function of the surface 39 is to guide the upper curved portion of the ring 31 as the halyard line is pulled so that it rides along the guide surface 39 and engages the nose 44 of a pawl 45, thereby raising it as will be explained further below.

The pawl 45 is pivotally mounted by means of a pin 49 to the hook plate 35. As best seen in FIGS. 5–9, first and second stop pins 51 and 52 are secured to the hook plate 37 to limit the positioning of the pawl 45 between a first or lowered position (in which one edge 54 of the pawl engages the pin 51) and a second or raised position (in which a second edge 55 of the pawl engages the pin 52. The pawl also includes an upper curved surface 56 which is indented at 57 adjacent the nose 44.

OPERATION

Figure 5:
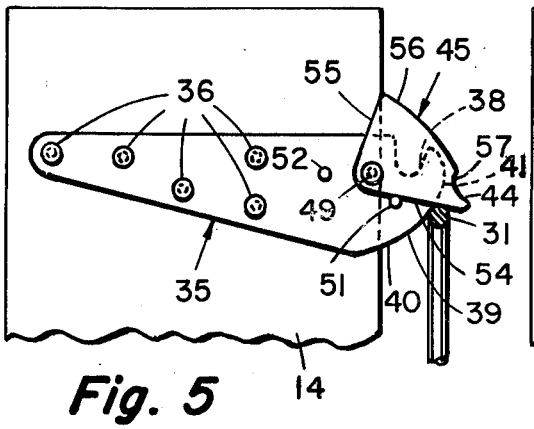
FIGS. 5–9 are fragmentary left side views of the halyard latch which illustrate in sequence, the operation of the invention.

Referring now to FIGS. 5–9, the operation and release of the latch mechanism will now be described. Referring first to FIG. 5, as the halyard line is raised, the ring 31 slides upwardly and outwardly along the curved surface 39 of the hook plate 35 until it engages the nose 44 of the pawl 45 (the position shown in FIG. 5). Further raising of the halyard line will cause the ring 31 to rotate the pawl from the closed position of FIG. 5 to the open position of FIG. 6 — thereby permitting the latch or seat 38 to be accessible.

Figure 6:
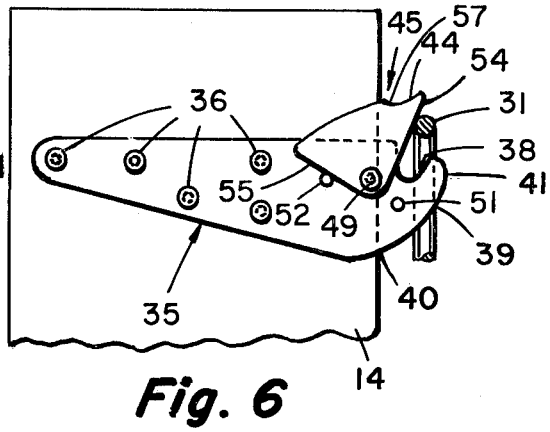
Figure 7:
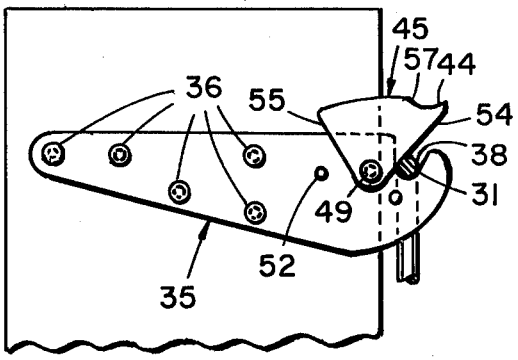

The raised position of the pawl is seen in FIG. 6; and it will be appreciated that if the halyard is then released, the ring 31 will be seated in the seat 38. The pawl will then rotate clockwise under gravity until the surface 54 of the pawl rests on the ring which is seated in the catch 38, as seen in FIG. 7.

Figure 8:
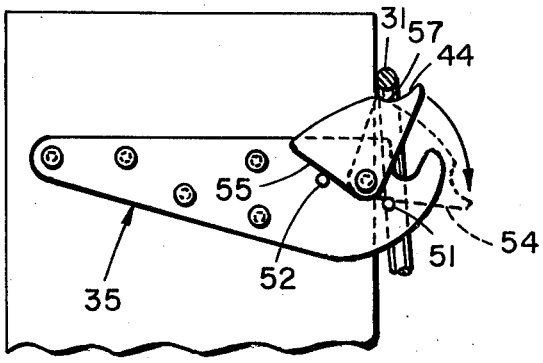
Figure 9:
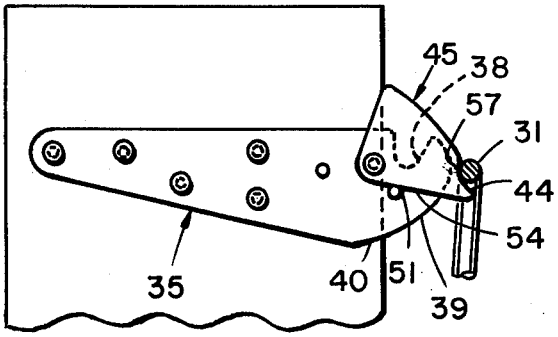

In order to release the latch, the halyard line is pulled to raise the ring 31. This causes the pawl to rotate counterclockwise again until it hits the limit defined by the pin 52 (see FIG. 8). As the halyard line is pulled slightly further, the ring 31 will be lifted above the pawl as seen in FIG. 8. The halyard line may then be released, and the ring 31 will fall downwardly into the detent 57 on the pawl. As the halyard line is released further, the weight of the sail will cause the pawl to rotate clockwise (if it has not already done so under gravity) as indicated by the arrow in FIG. 8, thereby camming the ring 31 outwardly beyond the catch 38, and free of the hook plate. When the pawl 35 is in the lowered position of FIG. 1 (that is, resting against the stop 51), the detent 57 is insufficient to hold the ring, and it will be released to ride along the surface 39 of the hook plate, and thence downwardly along the mast.

It will thus be appreciated that the present invention provides a halyard latch for a sailboat which secures the head of a sail to the mast in a simple and easy motion — namely, pulling the halyard line. Further, the release of the latch is also accomplished by tensioning the halyard line, and both latching and release may easily be accomplished while standing at the base of the mast.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. Apparatus for selectively latching and releasing a sail to a mast comprising: a pulley rotatably mounted to the mast; a line routed over said pulley and extending downwardly therefrom; connecting means for connecting the distal end of said line to said sail; catch means secured to said mast at a location at which it is desired to secure said sail; and a pawl rotatably mounted adjacent said catch means and extending outwardly thereof; whereby said pawl is adapted to be engaged by said connecting means when said sail is raised and rotated from a first position to a second position exposing said catch means, said catch means adapted to engage said connecting means for latching the same, said connecting means being released from said catch means by the application of further tension on said line to move said connecting means above said pawl, said connecting means thereupon engaging the top of said pawl and lowering the same as the sail is lowered to cover said catch means and prevent entry of said connecting means thereupon.

2. The apparatus of claim 1 wherein said connecting means comprises ring means secured to the head of said sail and having an upper portion adapted to be seated on said catch means when said pawl is rotated to said second position.

3. The apparatus of claim 2 wherein said catch means comprises a hook plate secured to said mast and extending to the rear thereof and defining a concave latch on the upper edge to engage said connecting means in the latched position, said hook plate defining a lower guide edge extending from a first location on said mast beneath said catch upwardly to a second location aft of said catch to guide said connecting means onto said catch when raised by said line.

4. Apparatus for selectively latching a mainsail to the top of a mast, comprising connector means secured to the head of the mainsail; a pulley rotatably mounted to the top of the mast; a halyard line secured to said connector means and extending over said pulley; a hook plate secured to said mast and extending to the rear thereof and defining a concave catch on the upper edge to provide a seat for said connector means in the latched position, said hook plate defining a lower guide edge extending from a first location adjacent said mast beneath said catch upwardly to a second location aft of said catch to guide said connector means onto said catch when raised by said halyard; and a pawl mounted to said hook plate for rotation between a lower position in which said pawl prevents said connector means from seating in said catch and a raised position in which said connector means may engage said catch, said pawl including a nose extending beyond said hook plate at said second location and adapted to be engaged by the top of said connector means when said connector means is raised by said halyard to rotate said pawl to said second position, whereby said connector means will be seated in said latch when said halyard is released.

* * * * *